US007827945B2

(12) United States Patent
Gregor et al.

(10) Patent No.: US 7,827,945 B2
(45) Date of Patent: Nov. 9, 2010

(54) CAMSHAFT OPERATING UNIT

(75) Inventors: Matthias Gregor, Stuttgart (DE); Jens Meintschel, Esslingen (DE); Thomas Stolk, Kirchheim (DE); Alexander Von Gaisberg-Helfenberg, Graz (DE)

(73) Assignee: Daimler AG, Stuttgart (DE)

( * ) Notice: Subject to any disclaimer, the term of this patent is extended or adjusted under 35 U.S.C. 154(b) by 445 days.

(21) Appl. No.: 11/986,796

(22) Filed: Nov. 26, 2007

(65) Prior Publication Data

US 2008/0141963 A1 Jun. 19, 2008

Related U.S. Application Data

(63) Continuation-in-part of application No. PCT/EP2006/004803, filed on May 20, 2006.

(30) Foreign Application Priority Data

May 27, 2005 (DE) ..... 10 2005 024 485

(51) Int. Cl.
*F01L 1/34* (2006.01)

(52) U.S. Cl. ..... 123/90.15; 123/90.17; 464/160

(58) Field of Classification Search ..... 123/90.15, 123/90.17, 90.31; 464/1, 2, 160
See application file for complete search history.

(56) References Cited

U.S. PATENT DOCUMENTS 5,234,088 A 8/1993 Hampton

FOREIGN PATENT DOCUMENTS

| | | |
|---|---|---|
| DE | 39 33 923 | 4/1991 |
| DE | 100 38 354 | 2/2002 |
| DE | 201 05 838 | 9/2002 |
| DE | 101 16 300 | 10/2003 |
| EP | 0 424 103 | 4/1991 |
| EP | 1 533 483 | 5/2002 |
| GB | 2 245 684 | 1/1992 |
| GB | 2 285 671 | 7/1995 |
| JP | 2002266608 | 9/2002 |
| JP | 2008 512744 | 8/2004 |
| WO | WO 02/101207 | 12/2002 |
| WO | WO 2005/061861 | 7/2005 |
| WO | WO 2005/111384 | 11/2005 |

*Primary Examiner*—Ching Chang
(74) *Attorney, Agent, or Firm*—Klaus J. Bach

(57) ABSTRACT

In a camshaft operating unit having a friction torque variation simulation arrangement for controlling a camshaft adjustment device with at least two camshafts one of which is at least adjustable camshaft and at least one camshaft adjusting unit, the friction torque variation simulation arrangement is provided to simulate a friction torque camshaft required to rotate the camshaft.

13 Claims, 6 Drawing Sheets

CAMSHAFT OPERATING UNIT

This a Continuation-In-Part Application of pending International Patent Application PCT/EP2006/004803 filed May 20, 2006 and claiming the priority of German patent application 10 2005 024 485.8 filed May 27, 2005.

BACKGROUND OF THE INVENTION

The invention relates to a camshaft operating unit including a friction torque simulation arrangement for simulating a friction torque variation of a camshaft.

DE 100 38 354 A1 discloses a camshaft device having a camshaft and a camshaft adjusting unit. The camshaft adjusting unit has an epicyclic summing gearing and an electric adjusting motor. A first input of the epicyclic summing gearing is connected to a crankshaft of an internal combustion engine, and a second input of the epicyclic summing gearing is connected to the adjusting motor, while the camshaft is connected to an output of the epicyclic summing gearing. A phase position of the camshaft with respect to the crankshaft can be adjusted by means of an actuation of the adjusting motor.

It is the main object of the invention to provide a camshaft operating unit with reduced manufacturing cost and construction expenditures.

SUMMARY OF THE INVENTION

In a camshaft operating unit having a friction torque variation simulation arrangement for controlling a camshaft adjustment device with at least two camshafts one of which is at least adjustable camshaft and at least one camshaft adjusting unit, the friction torque variation simulation arrangement is provided to simulate a friction torque camshaft required to rotate the camshaft.

The friction torque variation simulation unit provided in particular for a camshaft device with at least one adjustable camshaft and at least one camshaft adjusting unit, with the friction torque variation simulation unit being provided to simulate friction torque variations at a camshaft. In this context, a "friction torque" should be understood to mean all forces which act on the camshaft as a result of bearing forces, gas exchange valve operating forces and/or also forces effective as a result of other auxiliary units connected to the camshaft. "Provided" should be understood in particular to mean specifically "equipped", "designed" and/or "programmed". In addition, a "simulation of a friction torque variation" should be understood to mean a simulation of a reduced friction torque, by virtue of an actual additional torque, which acts counter to an actual friction torque, being introduced by means of the friction torque variation simulation unit, and/or a simulation of an increased friction torque and in particular a simulation of a purely fictitious friction torque, by virtue of an additional torque which acts in the direction of an actual and/or a desired friction torque being introduced.

With the solution according to the invention, it is possible to prevent that high friction torques become effective in adjusting inputs of camshaft adjusting units. In addition, the camshaft adjusting devices can be dimensioned to be weaker and be designed to be more cost-effective and to require less space. In addition, excessively low friction torques which act in adjusting inputs can be increased, or non-existent friction torques can be simulated, and the total torque which acts on the adjusting input can advantageously be utilized for adjustment of the camshaft, in connection with a passive adjustment, that is to say for an adjustment by introducing and/or removing a braking torque within an epicyclic gearing, which is assigned in particular to an inner camshaft of a coaxial camshaft arrangement. In this context, an "adjusting input" is to be understood in particular to mean the input of an adjusting actuator, for example an adjusting motor or an adjusting brake unit etc. By means of the friction torque variation simulation unit, it is possible to create a torque which can be utilized for the passive adjustment in particular of an inner camshaft of a coaxial camshaft arrangement.

Differently-acting torques at the camshafts, caused in particular by friction forces, gas forces and/or auxiliary units, can be at least largely compensated, and it is possible in particular for camshaft adjusting units which are assigned to the camshafts to be at least correspondingly dimensioned, and for costs and installation space to be saved, specifically in particular if the friction torque variation simulation unit is designed such that torques which act at at least two adjusting inputs of at least two camshafts are on average, and in particular in a steady-state mode, at least substantially equal. Here, a "steady-state mode" is to be understood in particular to mean a mode in which no adjustment actuation takes place. In addition, "at least substantially equal" should be understood to mean that average torques which act at the adjusting inputs differ in magnitude by less than 20%, preferably less than 10% and particularly preferably less than 5%.

It is also proposed that the friction torque variation simulation unit is provided to support two torque transmitting means with a torque. It is possible to realize an alignment in a structurally simple, cost-effective and space-saving manner, and it is possible in particular to utilize a friction torque which acts at a torque transmitting means, in order to simulate a friction torque, so that an additional energy supply can be avoided. A "torque transmitting means" should be understood here to mean in particular shafts, gearwheels, pulleys, wrap-around drives etc.

The friction torque variation simulation unit can have various torque transmitting means which would appear to a person skilled in the art to be expedient, such as for example hydraulic or pneumatic torque transmitting means etc. However, the friction torque variation simulation unit preferably has at least one torque transmitting means which is formed by a mechanical spring element, which can be easily integrated into existing structures and can advantageously be utilized as an energy store which permits relative movements.

Various mechanical spring elements may be used such as for example coil-type pressure springs or coil-type tension springs, which act by means of a lever arm on a torque transmitting means etc. However, particularly advantageous is a torsion spring, such as a spiral spring etc. and especially a torsion bar. A corresponding spring is preferably rotationally symmetrical, and is integrated into the camshaft in a structurally simple manner. In addition, a corresponding spring element can be integrated in a particularly space-saving manner, at least partially within a shaft.

The friction torque variation simulation unit can act between different components which would appear to a person skilled in the art to be expedient, in particular between different torque transmitting means. If the friction torque variation simulation unit is provided to act directly between two camshafts, it is possible to obtain relatively small maximum rotational angles within the friction torque variation simulation unit, mainly because the maximum rotational angle generated within the friction torque variation simulation unit at least substantially corresponds to a maximum rotational angle between the camshafts. Here, "directly" should be understood to mean an action without a further interposed torque transmitting means whose phase angle is adjustable relative to the directly coupled torque transmitting means.

If the friction torque variation simulation unit is arranged directly between two adjusting inputs, it is possible by means of transmission ratios of interposed epicyclic gearings to obtain reduced torques within the friction torque variation simulation unit.

Also proposed is a camshaft device which has a camshaft unit according to the invention and at least two coaxially and preferably concentrically arranged camshafts. It is possible to obtain a space-saving construction and it is possible for friction torque differences between an inner and an outer camshaft to advantageously be at least largely compensated and/or it is advantageously possible to realize a passive adjustment at both camshafts, in particular also at the inner camshaft which is not subjected to any friction torque by a bearing arrangement.

If the camshaft device has a drive means of a camshaft and at least one other drive means of another camshaft, with the one drive means extending through the other drive means, it is again possible to save on installation space. Also, the flexibility can be increased with regard to the installation space configuration.

In a further embodiment the camshaft device has at least one camshaft adjusting unit with a gearing unit which permits arbitrary phase angles of a camshaft, whereby a particularly high degree of flexibility in terms of use can be obtained. Here, the gearing unit is preferably formed by an epicyclic gearing, for example by a planetary gearing, though other units are also conceivable.

If the camshaft device has at least one camshaft adjusting unit with at least one brake unit, wherein different phase angles of a camshaft can be provided by varying a braking torque, it is possible to realize devices which are particularly space-saving and are particularly advantageous in terms of energy.

In a further embodiment of the invention, it is proposed that the camshaft device has one gearing unit which is assigned to one camshaft, and at least one further gearing unit which is assigned to a further camshaft, with the gearing units being provided to be driven by a common drive device, specifically in particular in parallel. Additional drive devices can be avoided and installation space, components, weight, assembly expenditure and costs can be reduced.

The invention will become more readily apparent from the following description of exemplary embodiments of the invention on the basis of the accompanying drawing.

DESCRIPTION OF VARIOUS EMBODIMENTS

Figure 1:
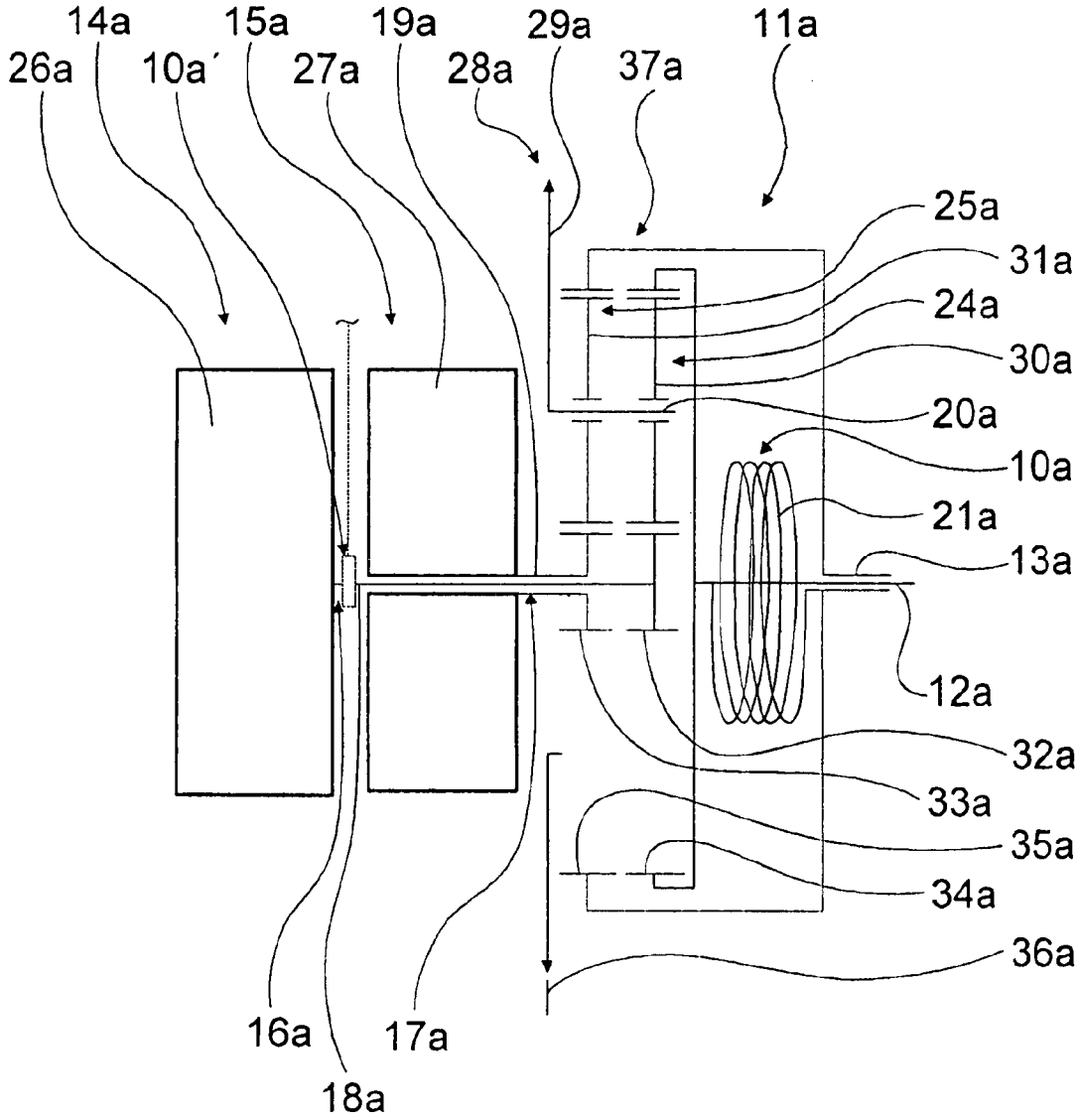
FIG. 1 is a schematic illustration of a first camshaft device having a friction torque variation simulation unit which acts directly between camshafts.

FIG. 1 is a schematic illustration of a camshaft adjustment device 11*a* of an internal combustion engine of a motor vehicle having two coaxially and concentrically arranged camshafts 12*a*, 13*a* and two camshaft adjusting units 14*a*, 15*a*, by means of which phase angles of the camshafts 12*a*, 13*a* can be adjusted relative to one another and in particular relative to a drive device 28*a* connected to a crankshaft (not illustrated in detail). In addition, the camshaft adjustment device 11*a* comprises a camshaft unit having a friction torque variation simulation unit 10*a* which is provided to simulate a friction torque variation at the camshafts 12*a*, 13*a*.

In operation, the crankshaft acts via a drive chain 36*a* and via a sprocket 29*a* in parallel on a first gearing unit 24*a*, which is formed by a first planetary partial gear set, and on a second gearing unit 25*a*, which is formed by a second planetary partial gear set, of a double adjusting gearing 37*a*. The first gearing unit 24*a* is a part of the first camshaft adjusting unit 14*a* and is assigned to the first camshaft 12*a*, and the second gearing unit 25*a* is a part of the second camshaft adjusting unit 15*a* and is assigned to the second camshaft 13*a*.

Rotationally fixedly connected to the sprocket 29*a* is a common planet carrier 20*a* of the gearing units 24*a*, 25*a*, on which common planet carrier 20*a* planets 30*a* of the first gearing unit 24*a* and planets 31*a* of the second gearing unit 25*a* are rotatably supported. The planets 30*a* mesh with a ring gear 34*a* of the first gearing unit 24*a*, which ring gear 34*a* is rotationally fixedly coupled to the first, inner camshaft 12*a*. The planets 31*a* mesh with a ring gear 35*a* of the second gearing unit 25*a*, which ring gear 35*a* is rotationally fixedly coupled to the second, outer camshaft 13*a*.

The first camshaft adjusting unit 14*a* has a first brake unit 26*a* which is coupled to a sun gear 32*a* of the first gearing unit 24*a*, and the second camshaft adjusting unit 15*a* has a second brake unit 27*a* which is coupled to a sun gear 33*a* of the second gearing unit 25*a*. By varying a braking torque of the first brake unit 26*a*, it is fundamentally possible to set an arbitrary phase angle of the first camshaft 12*a*, and by varying a braking torque of the second brake unit 27*a*, it is fundamentally possible to set an arbitrary phase angle of the second camshaft 13*a*. Instead of brake units 26*a*, 27*a* other actuators such as for example electric motors etc. may be used.

The friction torque variation simulation unit 10*a* is provided to brace the two camshafts 12*a*, 13*a* directly with a torque load. For this purpose, the friction torque variation simulation unit 10*a* has a torque transmitting means which is formed by a mechanical spring element 21*a*. The spring element 21*a* is formed by a torsion spring, specifically a spiral spring, which is coupled with a first end directly to the first camshaft 12*a* and with a second end directly to the second camshaft 13*a*.

The friction torque variation simulation unit 10*a* is designed in such a way that torques which act in operation at two adjusting inputs 16*a*, 17*a* of the camshafts 12*a*, 13*a* or at two output shafts 18*a*, 19*a* of the brake units 26*a*, 27*a* are on average, or in a steady-state mode, substantially equal, that is to say differ by a maximum of approximately 5% in magnitude. The output shaft 18*a* is rotationally fixedly connected directly to the sun gear 32*a* of the first gearing unit 24*a*, and the output shaft 19*a* is rotationally fixedly connected directly to the sun gear 33*a* of the second gearing unit 25*a*.

The friction torque variation simulation unit 10*a* therefore simulates, in operation, a friction torque at the inner camshaft 12*a*, at which substantially no friction torque acts in a steady-state mode on account of the bearing arrangement within the outer camshaft 13*a*, and simulates a reduced friction torque at the outer camshaft 13*a*.

In the steady-state mode, the braking torques introduced by the brake units 26*a*, 27*a* substantially correspond to a drive torque of the drive device 28*a* which is applied to the sprocket 29*a*. If the braking torque of the brake unit 26*a* and/or of the brake unit 27*a* is increased, a phase adjustment in the early direction takes place; if the braking torque of the brake unit 26*a* and/or of the brake unit 27*a* is reduced, a phase adjustment in the late direction takes place as a result of the utilization of the simulated friction torque at the inner camshaft 12*a* and/or as a result of the utilization of the simulated reduced friction torque at the outer camshaft 13*a*.

Instead of a bracing of two torque transmitting means, it is also possible for a friction torque variation simulation unit 10*a*' to be provided which acts on only one torque transmitting means of the camshaft device 11*a*, for example only on one camshaft or on one adjusting input 16*a*, as is indicated in FIG. 1. Here, a torque which simulates a friction torque can be realized by means of a hydraulic unit and/or by means of an electromagnetic unit, for example by means of an eddy-current unit etc.

FIGS. 2 to 6 illustrate alternative camshaft devices 11*b*-11*f*. Substantially identical components are fundamentally denoted by the same reference symbols, with the letters a-f being added to the reference symbols in order to distinguish between the exemplary embodiments. In addition, with regard to identical features and functions, reference can be made to the description regarding the exemplary embodiment in FIG. 1. The following description is restricted substantially to the differences with respect to the exemplary embodiment in FIG. 1.

Figure 2:
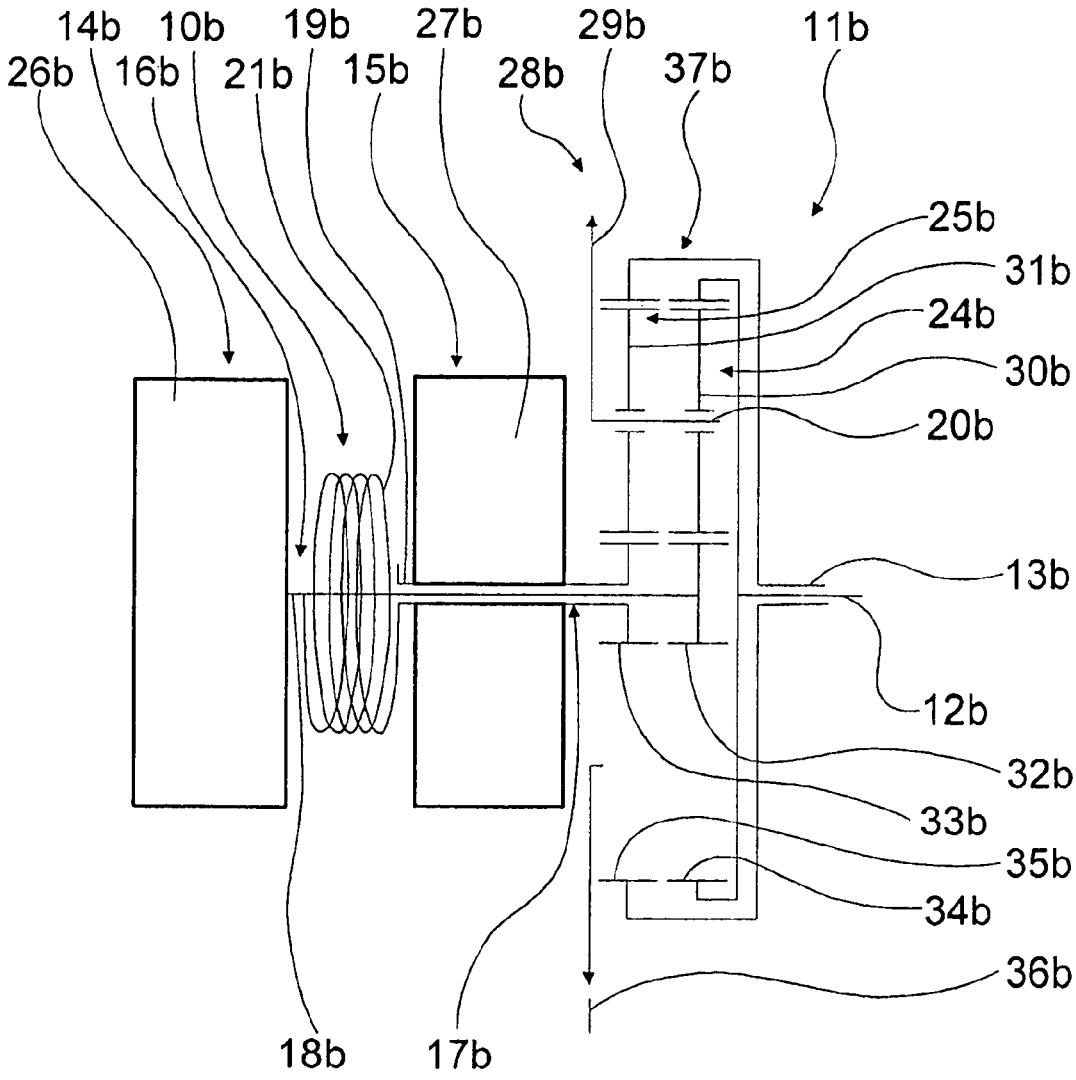
FIG. 2 is a schematic illustration of a further camshaft device having a friction torque variation simulation unit which acts directly between adjusting inputs.

In contrast to the camshaft device 11*a* in FIG. 1, the camshaft device 11*b* in FIG. 2 has a friction torque variation simulation unit 10*b* which is provided to act directly between two adjusting inputs 16*b*, 17*b* of two camshafts 12*b*, 13*b* or to brace two output shafts 18*b*, 19*b* of two brake units 26*b*, 27*b*. Here, the brake unit 26*b* is a constituent part of a first camshaft adjusting unit 14*b*, and the brake unit 27*b* is a constituent part of a second camshaft adjusting unit 15*b*. For this purpose, the friction torque variation simulation unit 10*b* has a torque transmitting means which is formed by a mechanical spring element 21*b*. The spring element 21*b* is formed by a torsion spring, specifically by a spiral spring, which is coupled with a first end directly to the output shaft 18*b* and with a second end directly to the output shaft 19*b*. The output shaft 18*b* is directly coupled to a sun gear 32*b* of a first gearing unit 24*b* of the first camshaft adjusting unit 14*b* and the output shaft 19*b* is directly coupled to a sun gear 33*b* of a second gearing unit 25*b* of the second camshaft adjusting unit 15*b*.

Figure 3:
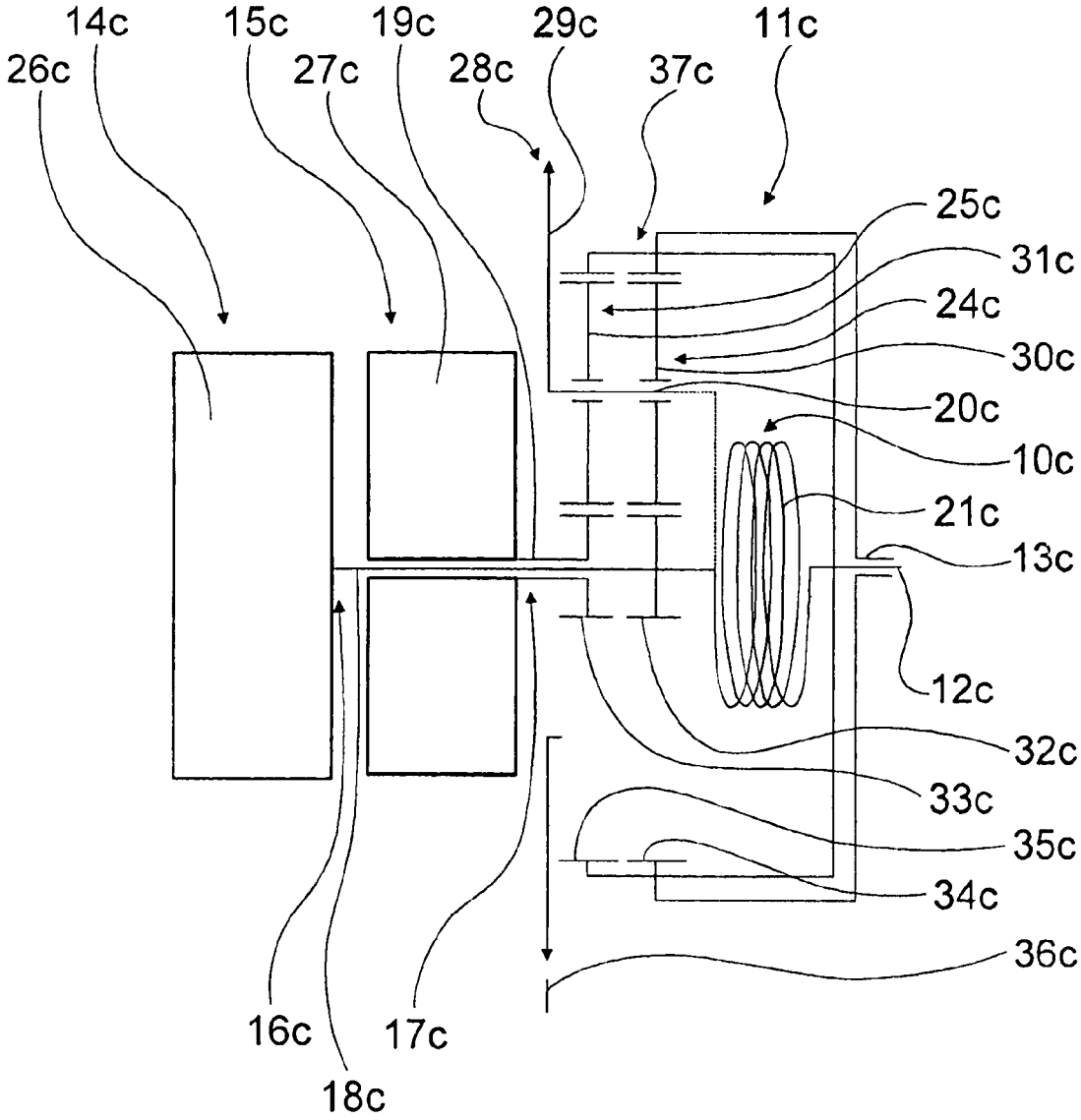
FIG. 3 is a schematic illustration of a further camshaft device having a friction torque variation simulation unit which acts directly between an adjusting input and a camshaft.

In contrast to the camshaft device 11*a* in FIG. 1, the camshaft device 11*c* in FIG. 3 has a friction torque variation simulation unit 10*c* which is provided to act directly between an adjusting input 16*c* of an outer camshaft 13*c* and an inner camshaft 12*c*, or to brace the camshaft 12*c* and an output shaft 18*c* of a brake unit 26*c*, with the brake unit 26*c* being a constituent part of a camshaft adjusting unit 14*c*, by means of which a phase angle of the outer camshaft 13*c* can be adjusted.

For this purpose, the friction torque variation simulation unit 10*c* has a torque transmitting means which is formed by a mechanical spring element 21*c*. The spring element 21*c* is formed by a torsion spring, specifically by a spiral spring, which is coupled with a first end directly to the output shaft 18*c* or to a sun gear 32*c* of a first gearing unit 24*c* of the camshaft adjusting unit 14*c*, and with a second end directly to the camshaft 12*c*. A drive means, specifically a ring gear 35*c*, of a second gearing unit 25*c* for driving the inner camshaft 12*c* is guided through a drive means, specifically through a ring gear 34*c*, of the first gearing unit 24*c*. For this purpose, the ring gear 35*c* has recesses which are adapted to a maximum rotational angle of the two camshafts 12*c*, 13*c* relative to one another, specifically of approximately 50°.

Alternatively, the spring element 21*c* could also be connected to a sprocket 29*c* or to a planet carrier 20*c* and to a further torque transmitting means such as for example to the camshaft 12*c*, as indicated in FIG. 3.

Figure 4:
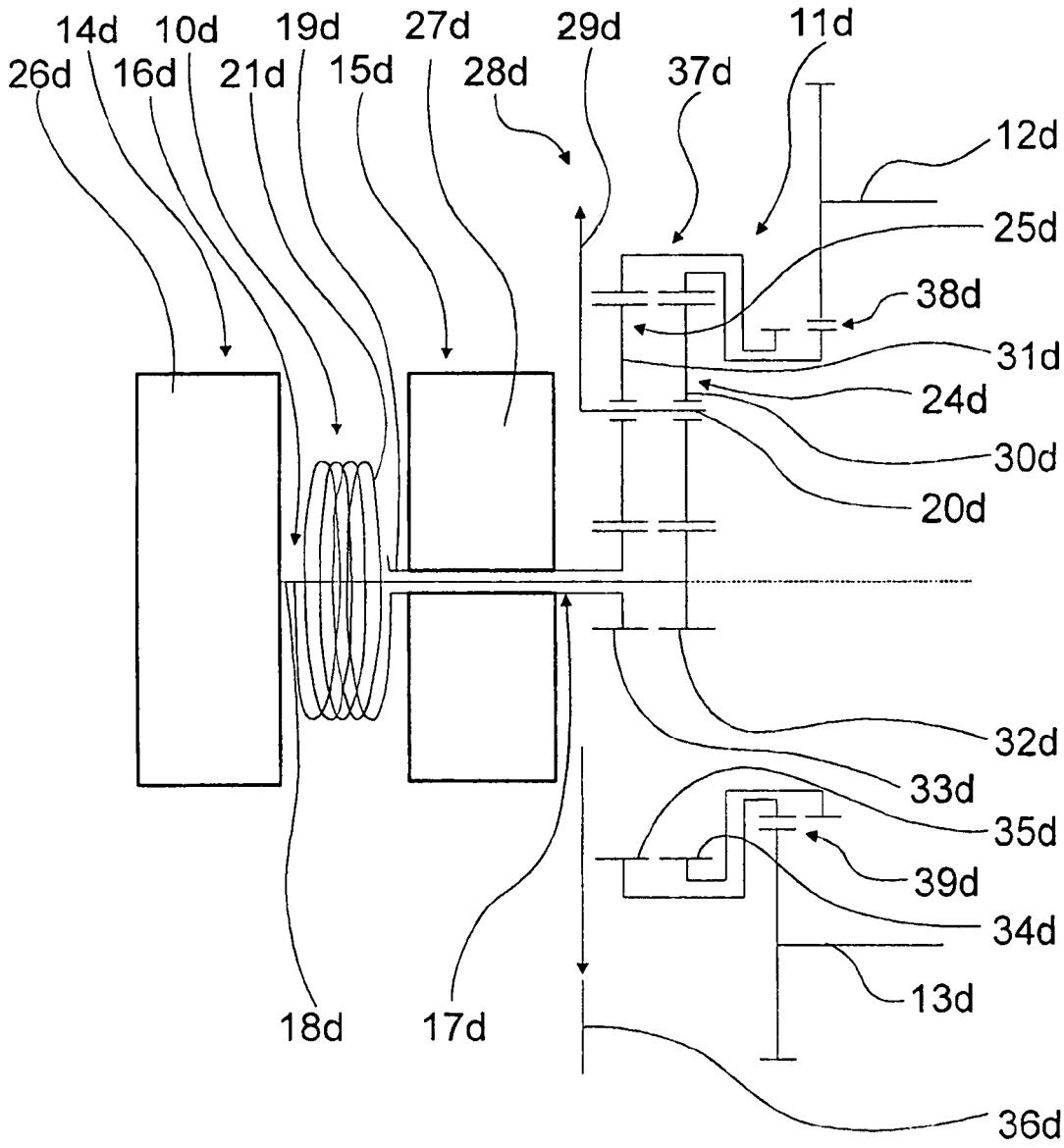
FIG. 4 is a schematic illustration of a camshaft device having camshafts which are arranged spaced from one another and can be driven by means of spur gear stages, and a friction torque variation simulation unit which acts between adjusting inputs.

The camshaft device 11*d* in FIG. 4 has, like the camshaft device 11*b* in FIG. 2, a friction torque variation simulation unit 10*d* which is provided to act directly between two adjusting inputs 16*d*, 17*d* of two camshafts 12*d*, 13*d* or to brace two output shafts 18*d*, 19*d* of two brake units 26*d*, 27*d*. In contrast to the camshaft device 11*b*, however, in the camshaft device 11*d*, the camshafts 12*d*, 13*d* are arranged adjacent to one another in parallel spaced relationship. Here, the camshafts 12*d*, 13*d* are driven in each case by means of a spur gear stage 38*d*, 39*d*.

Figure 5:
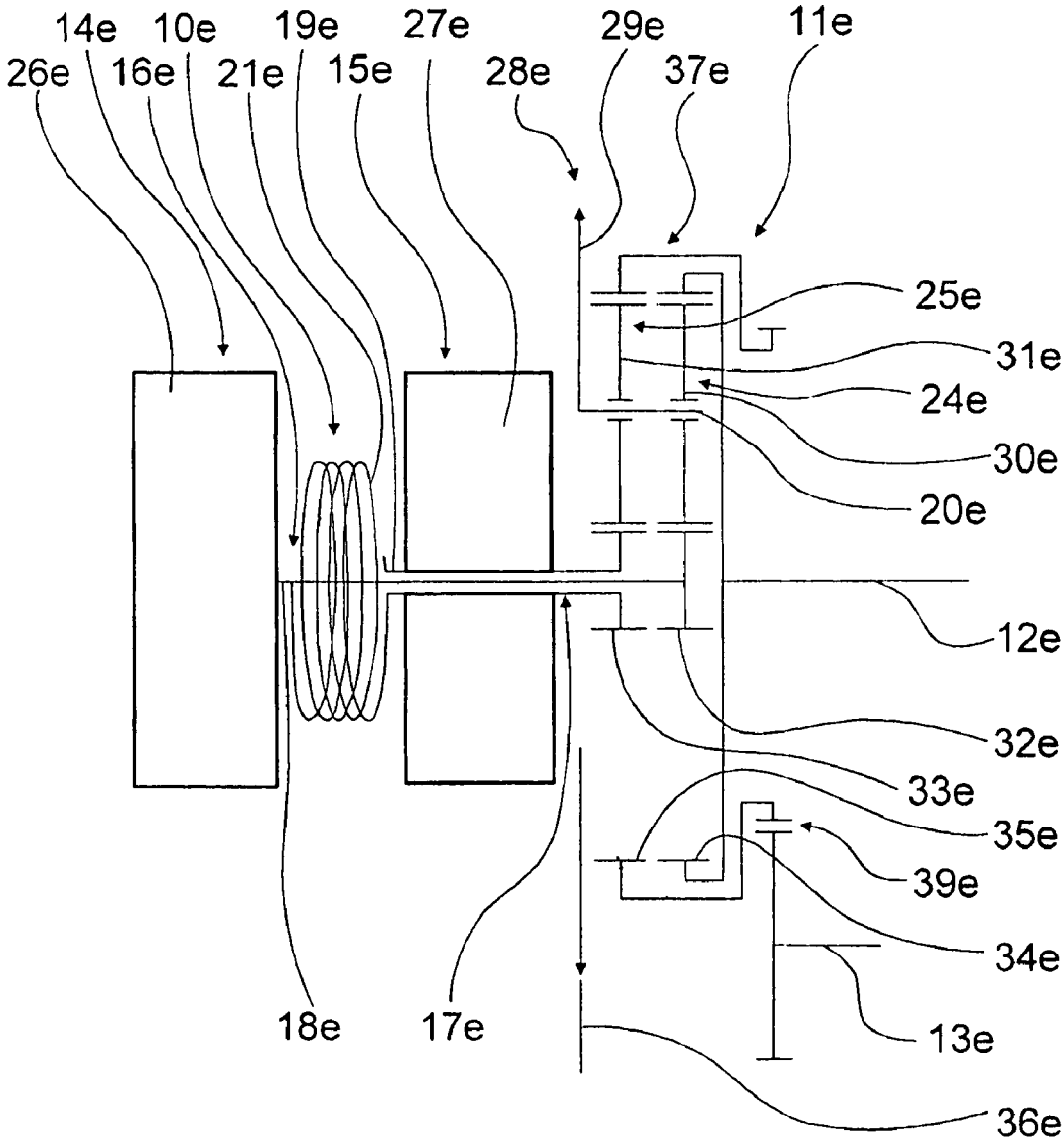
FIG. 5 shows an alternative camshaft adjusting device to FIG. 4 with a camshaft which is coupled directly to a ring gear, and a friction torque simulation unit disposed between adjusting inputs.

The camshaft device 11*e* in FIG. 5 differs from the camshaft device 11*d* in that only one camshaft 13*e* is driven by means of a spur gear stage 39*e*, while another camshaft 12*e* is directly coupled to a ring gear 34*e* of a gearing unit 24*e*.

Figure 6:
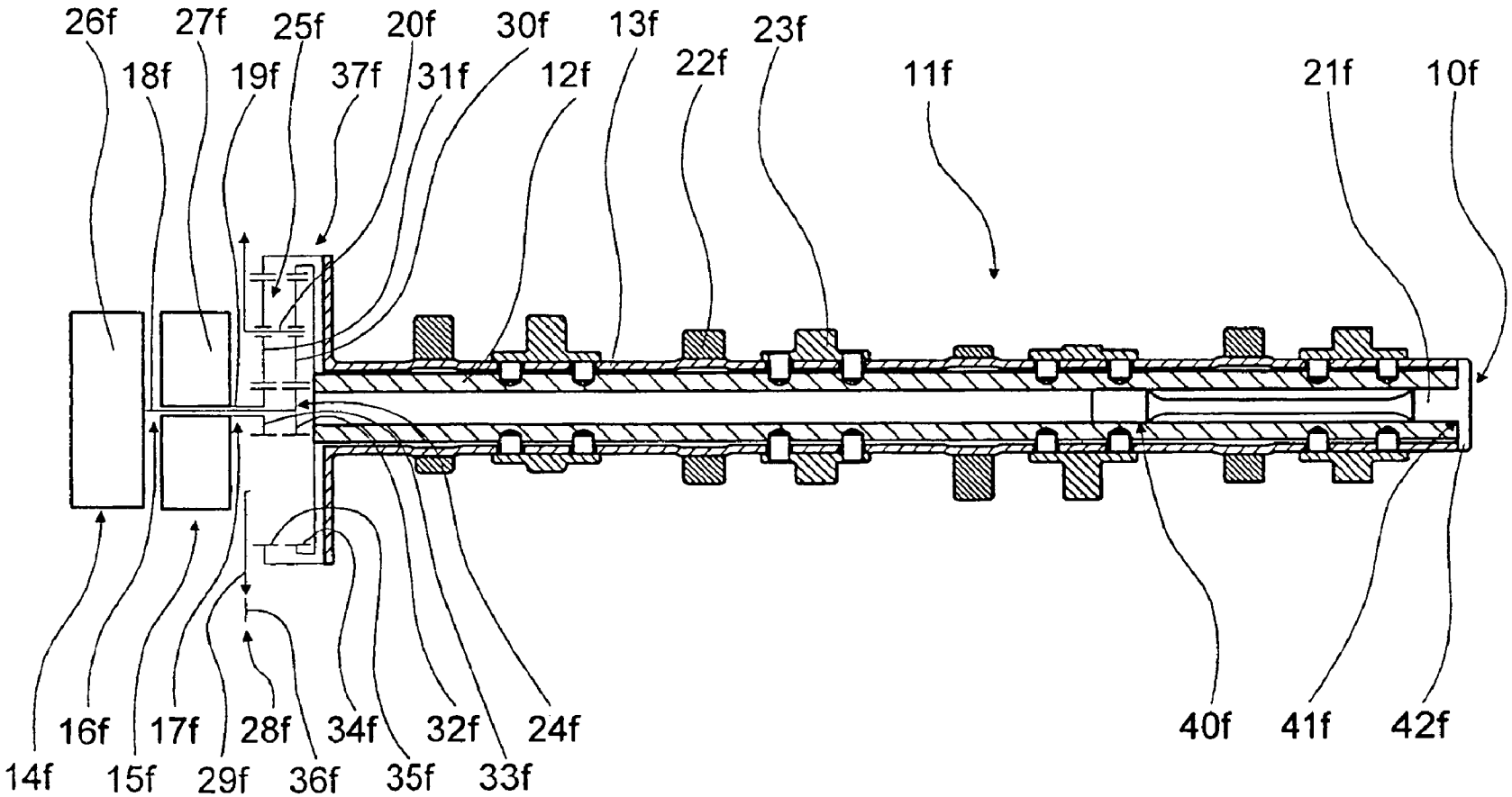
FIG. 6 is a schematic illustration of a camshaft device having a friction torque variation simulation unit which acts directly between camshafts and has a spring element which is formed by a torsion bar.

In contrast to the camshaft device 11*a* in FIG. 1, the camshaft device 11*f* in FIG. 6 has a friction torque variation simulation unit 10*f* which, instead of a spring element 21*a* which is formed by a spiral spring, has a spring element 21*f* which is formed by a torsion bar. The spring element 21*f* is inserted, on a side which faces away from a drive input side, into an inner camshaft 12*f* which is embodied as a hollow shaft, and is rotationally fixedly connected with a first, inner end 40*f* to the inner camshaft 12*f*. The spring element 21*f* projects with its second end 41*f* out of the inner camshaft 12*f*, and is rotationally fixedly connected by means of an integrally formed flange 42*f* to the outer camshaft 13*f*. With the exception of the first end 40*f* of the spring element 21*f*, the spring element 21*f* is arranged so as to be rotatable in the inner camshaft 12*f*. If a friction torque engages on the outer camshaft 13*f*, the spring element 21*f* is rotated with a torsional moment and transmits a torque, which simulates a friction torque, to the inner camshaft 12*f*.

The inner camshaft 12*f* has cams 23*f* which are rotatably mounted on the outer camshaft 13*f* and are rotationally fixedly connected, by means of recesses of the outer camshaft 13*f*, to the inner camshaft 12*f*. The-outer camshaft 13*f* has cams 22*f* which are rotationally fixedly arranged thereon.

What is claimed is:

1. A camshaft operating unit including a friction torque variation simulation unit (10*a*-10*f*) for a camshaft arrangement (11*a*-11*f*) with at least one adjustable camshaft (12*a*-12*f*, 13*a*-13*f*) and at least one camshaft adjusting unit (14*a*-14*f*, 15*a*-15*f*), the friction torque variation simulation unit (10*a*-10*f*) being provided to simulate a friction torque serving as compensation for friction differences between camshafts (12*a*-12*f*, 13*a*-13*f*) or camshaft drives, the friction torque variation simulation unit (10*a*-10*f*) being designed such that torques which are effective for at least two adjusting inputs (16*a*-16*f*; 17*a*-17*f*) of at least two camshafts (12*a*-12*f*; 13*a*-13*f*) are on average at least substantially equal.

2. The camshaft operating unit as claimed in claim 1, wherein the friction torque variation simulation unit (10*a*-10*f*) is provided to simulate a friction torque in order to compensate for friction torque differences between an inner camshaft (12*a*-12*f*) disposed within an outer camshaft (13*a*-13*c* and 12*f*).

3. The camshaft operating unit as claimed in claim 1, wherein the friction torque variation simulation unit (10*a*-10*f*) is provided as brace between two torque transmitting means with a torque.

4. The camshaft operating unit at least as claimed in claim 3, wherein the friction torque variation simulation unit (10*a*; 10*f*) is provided to act between two camshafts (12*a*, 13*a*; 12*f*; 13*f*).

5. The camshaft operating unit as claimed in claim 3, wherein the friction torque variation simulation unit (10*b*; 10*c*; 10*e*) is provided to act between two adjusting inputs (16*b*, 17*b*; 16*d*, 17*d*; 16*e*, 17*e*).

6. The camshaft operating unit as claimed in claim 1, wherein the friction torque variation simulation unit (10*a*-10*f*) includes at least one torque transmitting means which is formed by a mechanical spring element (21*a*-21*f*).

7. The camshaft operating unit as claimed in claim 6, wherein the mechanical spring element (21*a*-21*f*) is a torsion spring.

8. The camshaft operating unit as claimed in claim 7, wherein the mechanical spring element (21*f*) is a torsion bar.

9. The camshaft operating unit as claimed in claim 1, wherein at least two camshafts (12*a*, 13*a*; 12*b*, 13*b*; 12*c*, 13*c*; 12*f*, 13*f*) are arranged co-axially.

10. The camshaft operating device (11*c*) as claimed in claim 9, with a drive means for one camshaft (12*c*) and at least one other drive means for another camshaft (13*c*), wherein the one drive means extends through the other drive means.

11. The camshaft operating device (11*a*-11*f*) as claimed in claim 9, wherein at least one camshaft adjusting unit (14*a*-14*f*; 15*a*-15*f*) includes a gearing unit (24*a*-24*f*; 24*a*-25*f*) which permits the setting of arbitrary phase angles.

12. The camshaft operating device (11*a*-11*f*) as claimed in claim 11, including one gearing unit (24*a*-24*f*) which is assigned to one camshaft (12*a*-25*f*), and at least one further gearing unit (25*a*-25*f*), which is assigned to a further camshaft (13*a*-13*f*), with the gearing units (24*a*-24*f*; 25*a*-25*f*) being provided to be driven by a common drive device (28*a*-28*f*).

13. The camshaft operating device (11*a*-11*f*) as claimed in claim 9, wherein at least one camshaft adjusting unit (14*a*-14*f*; 15*a*-15*f*) has at least one brake unit (26*a*-26*f*; 27*a*-27*f*), such that different phase angles of the at least one camshaft with respect to the crankshaft can be set by varying a braking torque.

* * * * *